US011376457B2

(12) United States Patent
Silva, Jr. et al.

(10) Patent No.: US 11,376,457 B2
(45) **Date of Patent: *Jul. 5, 2022**

(54) FIRE PROTECTION SPRINKLER AND FITTING ASSEMBLY

(71) Applicant: Tyco Fire Products LP, Lansdale, PA (US)

(72) Inventors: Manuel R. Silva, Jr., Cranston, RI (US); Steven Lee Shields, Lubbock, TX (US); Gary J. Luiz, Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 66 days.

This patent is subject to a terminal disclaimer.

(21) Appl. No.: 16/645,116

(22) PCT Filed: Sep. 7, 2018

(86) PCT No.: PCT/US2018/050036

§ 371 (c)(1),
(2) Date: Mar. 6, 2020

(87) PCT Pub. No.: WO2019/051284

PCT Pub. Date: Mar. 14, 2019

(65) Prior Publication Data

US 2021/0031064 A1 Feb. 4, 2021

Related U.S. Application Data

(60) Provisional application No. 62/556,062, filed on Sep. 8, 2017.

(51) Int. Cl.
*A62C 37/11* (2006.01)
*A62C 35/68* (2006.01)
(Continued)

(52) U.S. Cl.
CPC ..... *A62C 37/11* (2013.01); *A62C 35/68* (2013.01); *B05B 1/265* (2013.01); *B05B 15/65* (2018.02)

(58) Field of Classification Search
CPC ..... A62C 37/11; A62C 35/68; B05B 15/65; B05B 1/265
(Continued)

(56) References Cited

U.S. PATENT DOCUMENTS 8,181,709 B2 * 5/2012 Oh ..... A62C 35/68 169/37
2011/0214886 A1 9/2011 Orr
(Continued)

FOREIGN PATENT DOCUMENTS

WO WO-2013/010098 A2 1/2013

OTHER PUBLICATIONS

International Search Report and Written Opinion for International Application No. PCT/US2018/050036, dated Nov. 5, 2018, 10 pages.

*Primary Examiner* — Christopher S Kim
(74) *Attorney, Agent, or Firm* — Foley & Lardner LLP

(57) ABSTRACT

A sprinkler assembly includes a connection fitting and a fire protection sprinkler. The connection fitting includes a tubular member with a first insertion end and a second insertion end with an internal conduit extending between the first and second insertion end along a longitudinal axis, the tubular member including an exterior surface and an inner surface, the inner surface defining a sealing surface between the first and second insertion ends circumscribed about the longitudinal axis and including a gripping portion axially spaced from the sealing surface. The fire protection sprinkler has a body defining an inlet and an outlet, a deflector spaced from the outlet, the body having an outer encasing surface sur-
(Continued)

rounding the longitudinal axis and including a leading portion and a trailing portion for insertion in the second insertion end with the leading portion received within the sealing surface before the trailing portion engages the gripping portion.

16 Claims, 10 Drawing Sheets

(51) Int. Cl.
*B05B 15/65* (2018.01)
*B05B 1/26* (2006.01)

(58) Field of Classification Search
USPC ..... 169/37
See application file for complete search history.

(56) References Cited

U.S. PATENT DOCUMENTS

2012/0273058 A1 11/2012 Spears
2014/0231105 A1 8/2014 Helasuo et al.

* cited by examiner

FIRE PROTECTION SPRINKLER AND FITTING ASSEMBLY

CROSS-REFERENCE TO RELATED APPLICATIONS

The present disclosure is a national stage application of International Application No. PCT/US2018/050036, filed Sep. 7, 2018, which claims the benefit of and priority to U.S. Provisional Application No. 62/556,062, titled "FIRE PROTECTION SPRINKLER AND FITTING ASSEMBLY," filed Sep. 8, 2017, the disclosure of which is incorporated herein by reference in its entirety.

BACKGROUND

The present disclosure relates generally to fire protection devices and more specifically to fire protection sprinkler and pipe connection assemblies.

SUMMARY

Embodiments of a fire protection sprinkler and connection assembly are provided having a tubular connection fitting in which a fire protection sprinkler is coaxially inserted and coupled to form a fluid tight connection. In some embodiments, the external configuration of the sprinkler body and the internal configuration of the fitting cooperate with one another to facilitate a positive alignment of the sprinkler within the fitting. In some embodiments, the sprinkler assembly permits the relative translation between the sprinkler body and the fitting for adjustability.

In some embodiments, a sprinkler assembly includes a connection fitting having a tubular member with a first insertion end and a second insertion end with an internal conduit extending between the first and second insertion end along a longitudinal axis. The tubular member includes an inner surface defining a sealing surface between the first and second insertion ends circumscribed about the longitudinal axis. The inner surface includes a gripping portion axially spaced from the sealing surface between the sealing surface and the second insertion end. The assembly also includes a fire protection sprinkler having a body defining an inlet and an outlet with a passageway extending between the inlet and the outlet with an outer encasing surface surrounding the first longitudinal axis. The outer encasing surface includes a leading portion and a trailing portion for insertion in the second insertion end of the tubular member with the leading portion being received within the sealing surface before the trailing portion engages the gripping portion.

In some embodiments, a method is provided for inserting the leading portion within the sealing surface to positively coaxially align with the body with the connection fitting; and subsequently engaging the trailing portion of the sprinkler body with the gripping portion of the connection fitting.

BRIEF DESCRIPTION OF THE DRAWINGS

The accompanying drawings, which are incorporated herein and constitute part of this specification, illustrate embodiments of the present disclosure, and together, with the general description given above and the detailed description given below, serve to explain the features of the present disclosure. It should be understood that the disclosed embodiments are some examples of the present disclosure as provided by the appended claims.

DETAILED DESCRIPTION

Figure 1:
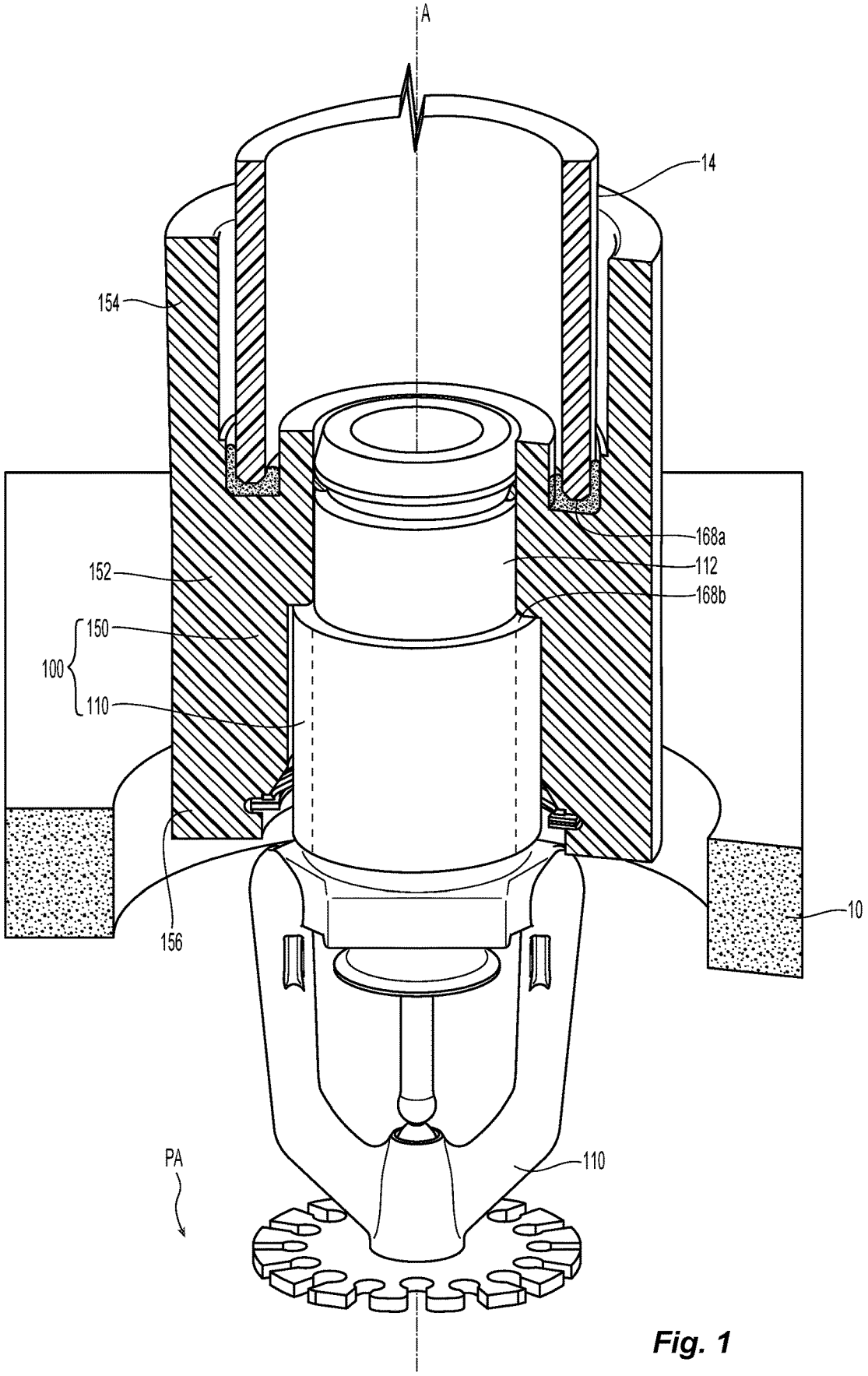
FIG. 1 is a diagram of an embodiment of a sprinkler assembly in an illustrative installation.

FIG. 1 depicts a sprinkler assembly 100 for the protection of an area, e.g., the protection area PA. The sprinkler assembly 100 is connected to a firefighting fluid supply pipe or pipe fitting 14. The mounted sprinkler can extend through a hole opening in a barrier, such as for example, a ceiling barrier 10 or wall. The hole can be finished with an escutcheon (not shown) to surround the sprinkler. The sprinkler assembly 100 includes a fire protection sprinkler 110 and a connection fitting 150 to connect the sprinkler 110 to fluid supply piping or fitting 14. One end of the fitting 150 is configured for connection to the fluid supply fitting 14. At the opposite end, the fitting 150 provides for connection to the sprinkler 110 with positive alignment between the two components to facilitate their connection. In some embodiments, the connection between the fitting 150 and the sprinkler 110 is formed by axially inserting or pushing the sprinkler 110 into the end of the fitting 150 to form a fluid tight connection. The assembly 100 maintains the connection and resists decoupling between the sprinkler 110 and the fitting 150. In some embodiments, the supply piping and pipe fittings are constructed from thermoplastic material, such as Chlorinated Poly Vinyl Chloride (CPVC) material suitable for use in fire sprinkler systems. The fitting 150 can be constructed from similar materials. In some embodiments, the supply pipe or fittings can be formed from metallic material, such as for example, steel or brass, etc.

Figure 2A:
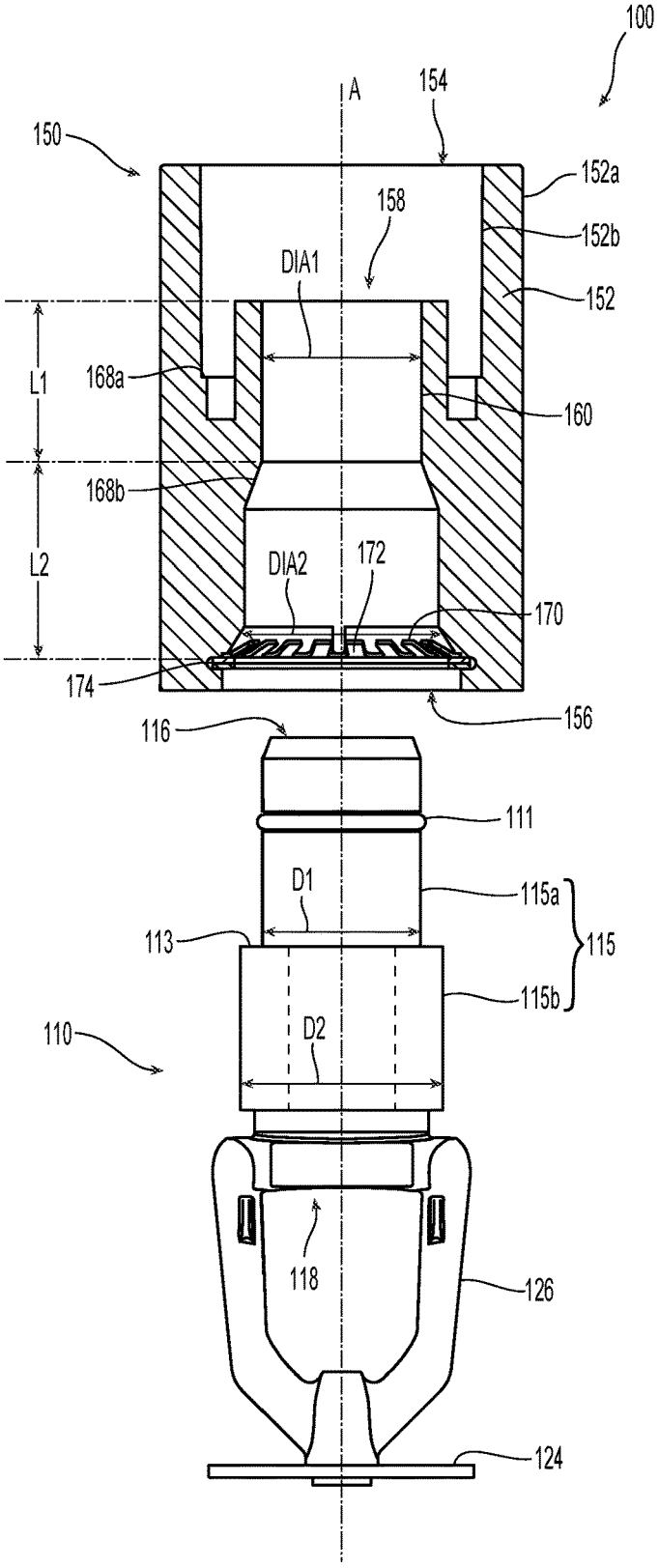
FIG. 2A is a partial cross-sectional exploded view of a fitting and fire protection sprinkler used in the sprinkler assembly of FIG. 1.
Figure 2B:
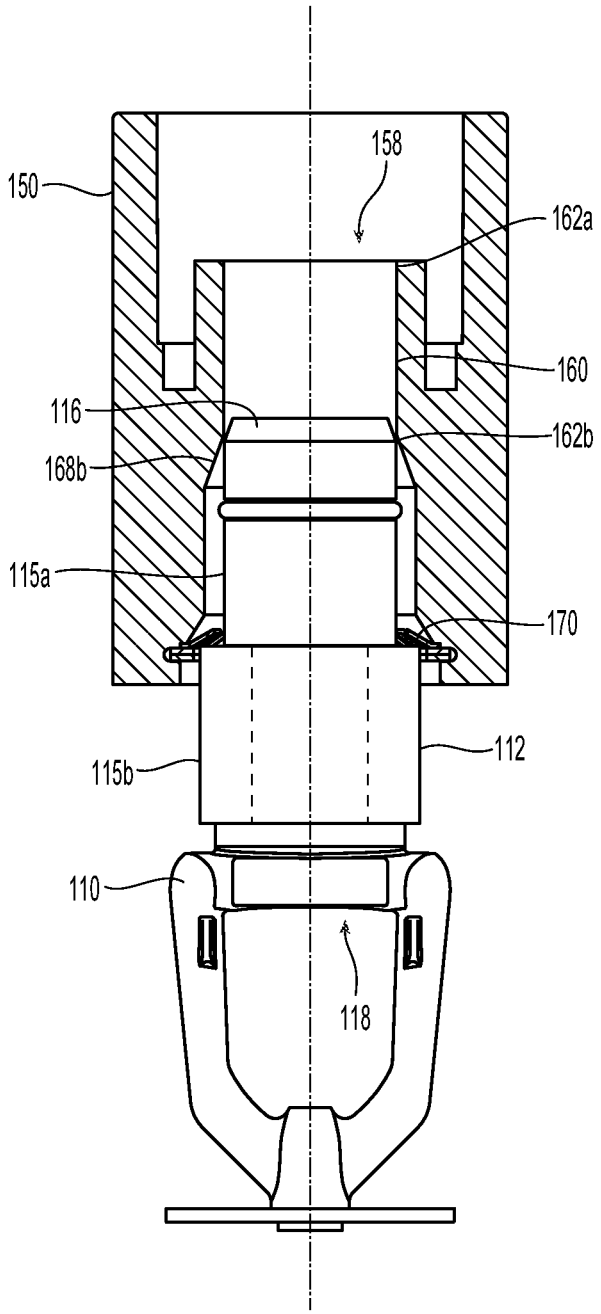
FIGS. 2B-2C are partial cross-sectional exploded views of the fire protection sprinkler assembly used in the installation of FIG. 1 in a unsealed condition.

With reference to FIGS. 2A and 2B, the fitting 150 includes a tubular member 152 with a first insertion end 154 for insertion and connection of the fluid supply pipe or fitting 14 and a second insertion end 156 for insertion and receipt of the sprinkler 110. The tubular member 152 includes an exterior surface 152*a* and an inner surface 152*b* that defines an internal conduit 158 which extends along a longitudinal axis A-A. A portion of the inner surface 152*b* of the tubular member 152 can define or form a sealing surface portion 160 which circumscribes the second longitudinal axis A-A and extends axially to define an axial length L1 between the first and second insertion ends 154, 156. In some embodiments, the sealing surface 160 forms a fluid tight seal with the sprinkler 110. The sealing surface 160 has a first end 162*a* and a second end 162*b* with the axial length L1 of the sealing surface 160 extending between the first and second ends 162*a*, 162*b* to define the range over which the sealing contact between the surface 160 and the sprinkler 110 can be located. In some embodiments, the sealing surface portion 160 facilitates the coaxial alignment of the sprinkler 110 within the internal conduit 158. The inner surface 152*b* can include a gripping portion 170, axially disposed between the sealing surface 160 and the second insertion end 156, to retain and, in some embodiments, adjustably locate the sprinkler 110 within the fitting 150. As depicted, the sealing surface 160 defines an internal diameter DIA1 that is smaller than the internal diameter DIA2 defined by the gripper portion 170.

Figure 6:
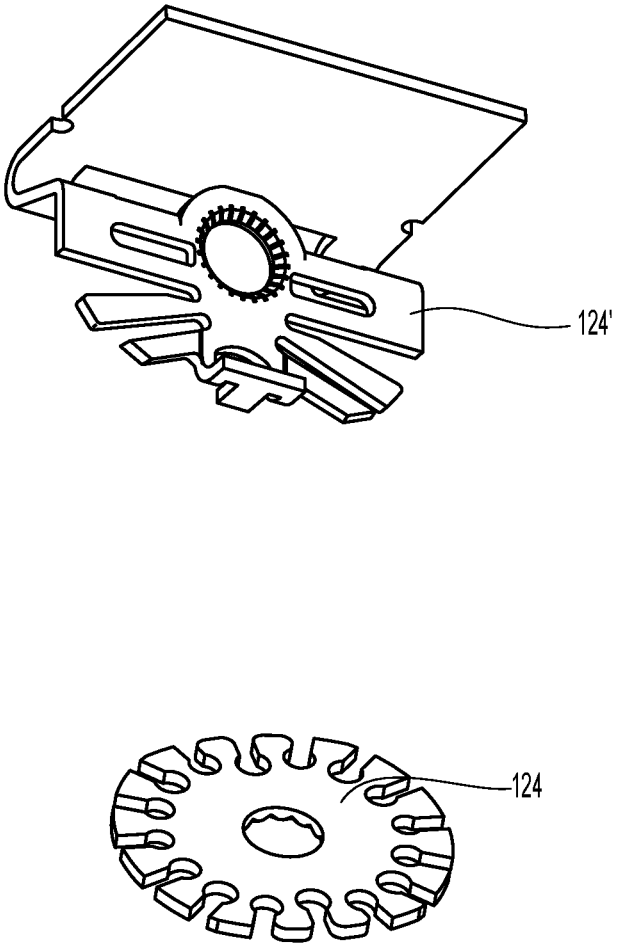
FIG. 6 is a diagram of deflectors for use in the sprinkler assemblies of FIGS. 2E, 4 and 5.

With reference to FIGS. 2A-2E and 3, the fire protection sprinkler 110 has a body 112 that includes an internal surface 112*a* extending along a first longitudinal axis A-A defining an internal passageway 114 extending between an inlet 116 and an outlet 118 of the body 112. The fire protection sprinkler 110 can be configured as an automatic sprinkler having a sealed assembly disposed within the outlet 118 supported by a thermally responsive trigger, as depicted for example in FIG. 3 (not shown in FIGS. 2A-2E). The sprinkler 110 includes a deflector 124 supported by the body 112 and spaced from the outlet 118. As depicted, the deflector 124 can be secured to a pair of frame arms 126 which depend from the sprinkler body 112. As depicted, the frame arms 126 locate the deflector 124 at the desired fixed axial distance from the outlet 118. In some embodiments, the frame arms can provide for a "drop down" arrangement in which the arms deploy from an unactuated concealed position to an actuated deployed position. The internal passageway 114 and outlet 118 are dimensioned and geometrically configured so as to affect desired discharge characteristics for the deflector 124 to provide for a sprinkler spray pattern that can effectively address a fire. The deflector can have any suitable geometry and configuration for a particular application. For example, as seen in FIG. 6, the deflector can be configured as a substantially planar member 124 used in a pendent configuration or a hooded deflector 124' for use in a horizontal orientation. In some embodiments, the deflector is domed for an upright sprinkler construction.

The inner surface 152*b* of the fitting 150 includes stop surfaces to limit the insertion of the fluid supply pipe fitting 14 and the sprinkler 110. In some embodiments, internally from the first end 154 of the tubular member 152 is a first stop surface 168*a* spaced from the first end 154 to define an insertion depth for the fluid supply pipe 14 and a second stop surface 168*b* to limit insertion of the sprinkler body 112. In some embodiments, the second end 156 of the tubular member 152 can include or form the second stop surface 168*b* that interferes with the sprinkler frame arms 126 or other portion of the sprinkler body 112 to limit the insertion of the sprinkler body 112. The second stop surface 168*b* of the fitting 150 can be formed as an annular planar surface disposed perpendicular or orthogonal to the second longitudinal axis A-A to limit the axial insertion of the sprinkler 110 into the passageway 158. In some embodiments, the second stop surface 168*b* can be skewed or chamfered with respect to the axis A-A. In some embodiments, the second stop surface 168*b* of the inner surface 152*b* defines a transition surface 170 contiguous with the sealing surface 160 and between the gripper portion 170 and the sealing surface 160. The sealing surface portion 160 or a portion thereof can extend between the first and second stop surface 168*a*, 168*b*. In some embodiments, the gripper portion 170 of the fitting is disposed between the second insertion end 156 and the second stop surface 160 to define an axial length L2 from the second stop surface 168*b*.

With reference to FIGS. 2A-2B, the body 112 has an outer encasing surface 115 that surrounds the longitudinal axis A-A. The outer encasing surface 115 includes a leading portion 115*a* and a trailing portion 115*b* for insertion in the second insertion end 156 of the fitting 150. The fitting 150 and sprinkler 110 can have complimentary configured components to positively coaxially align the sprinkler and the fitting to facilitate assembly. In some embodiments, the leading portion 115*a* has an axial length such that the leading portion is received within the sealing surface 160 before the trailing portion 115*b* of the sprinkler body 112 engages the gripping portion 170 of the fitting 150. The leading portion 115*a* can include a sealing member 111 and can define a first diameter D1 sized to support the annular sealing member 111, such as for example an O-ring, in engagement with the cylindrical sealing surface 160 of the fitting 150. The trailing portion 115*b* has a second diameter D2 that can be greater than the first diameter D1. The trailing portion 115*b* can form a mechanical connection with the gripper portion 170 to adjustably locate and retain the sprinkler 110 within the fitting 150.

The difference in diameters D1, D2 between the leading and trailing portions defines a step transition or shoulder surface 113 separating the first portion and second portions of the encasing surface 115. In some embodiments, the axial length of the leading portion 115*a* of the sprinkler body 112 is greater than the axial length L2 between the second stop surface 168*b* and the gripper portion 170. Accordingly upon insertion, the inlet 116 of the leading portion of the sprinkler 110 can be located within the sealing surface 160 of the fitting before the gripper portion 170 engages the trailing portion 115*b* to positively coaxially align the sprinkler 110 within the fitting 150, as depicted for example in FIG. 2B, to retain and couple the components in a manner as described herein.

Figure 2C:
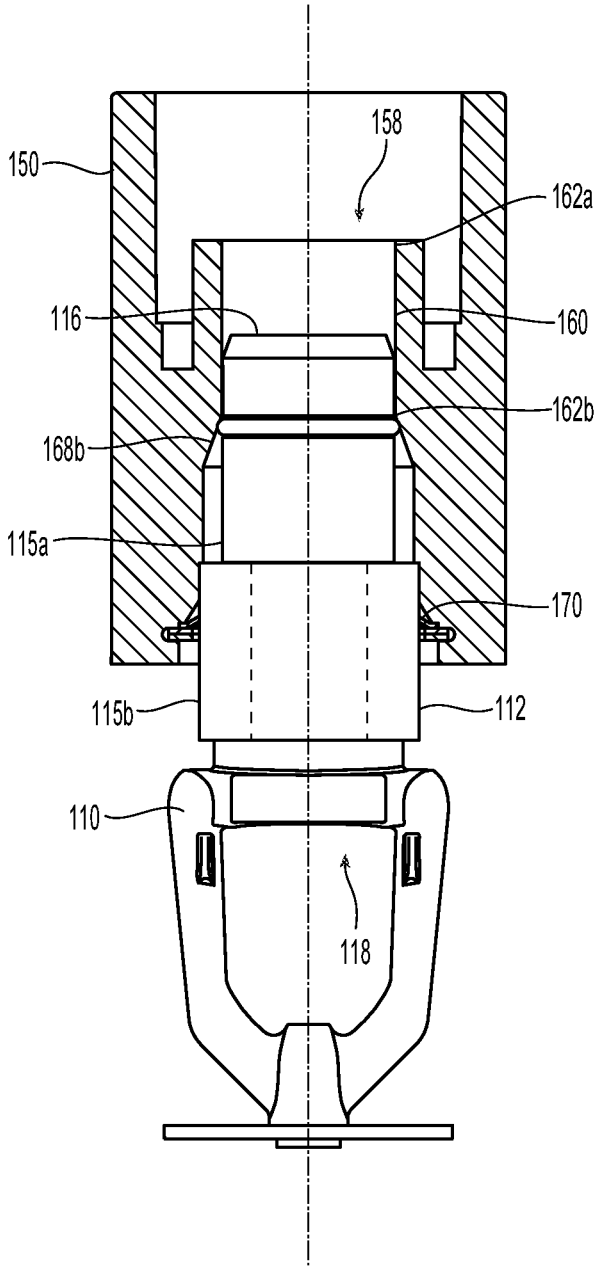
Figure 2D:
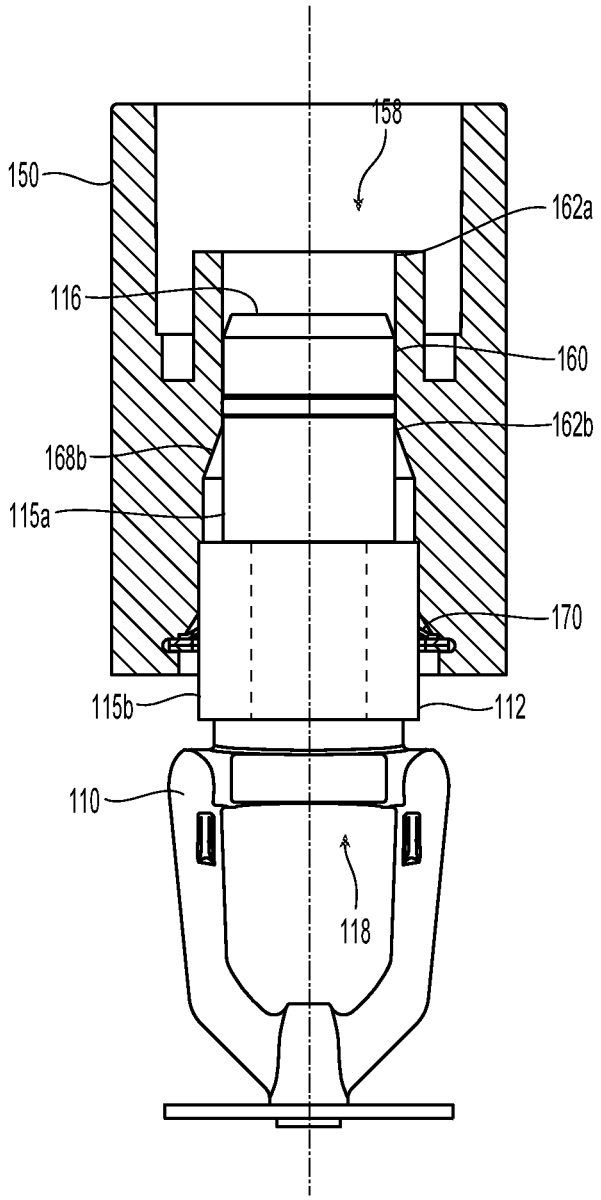
FIGS. 2D-2E are partial cross-sectional exploded views of the fire protection sprinkler assembly used in the installation of FIG. 1 in a sealed condition.
Figure 2E:
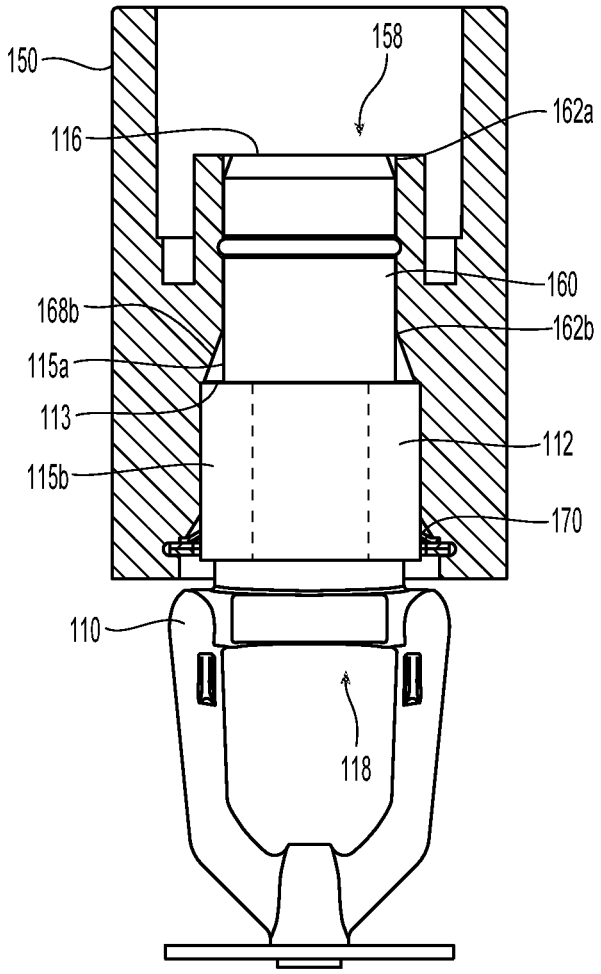
Figure 3:
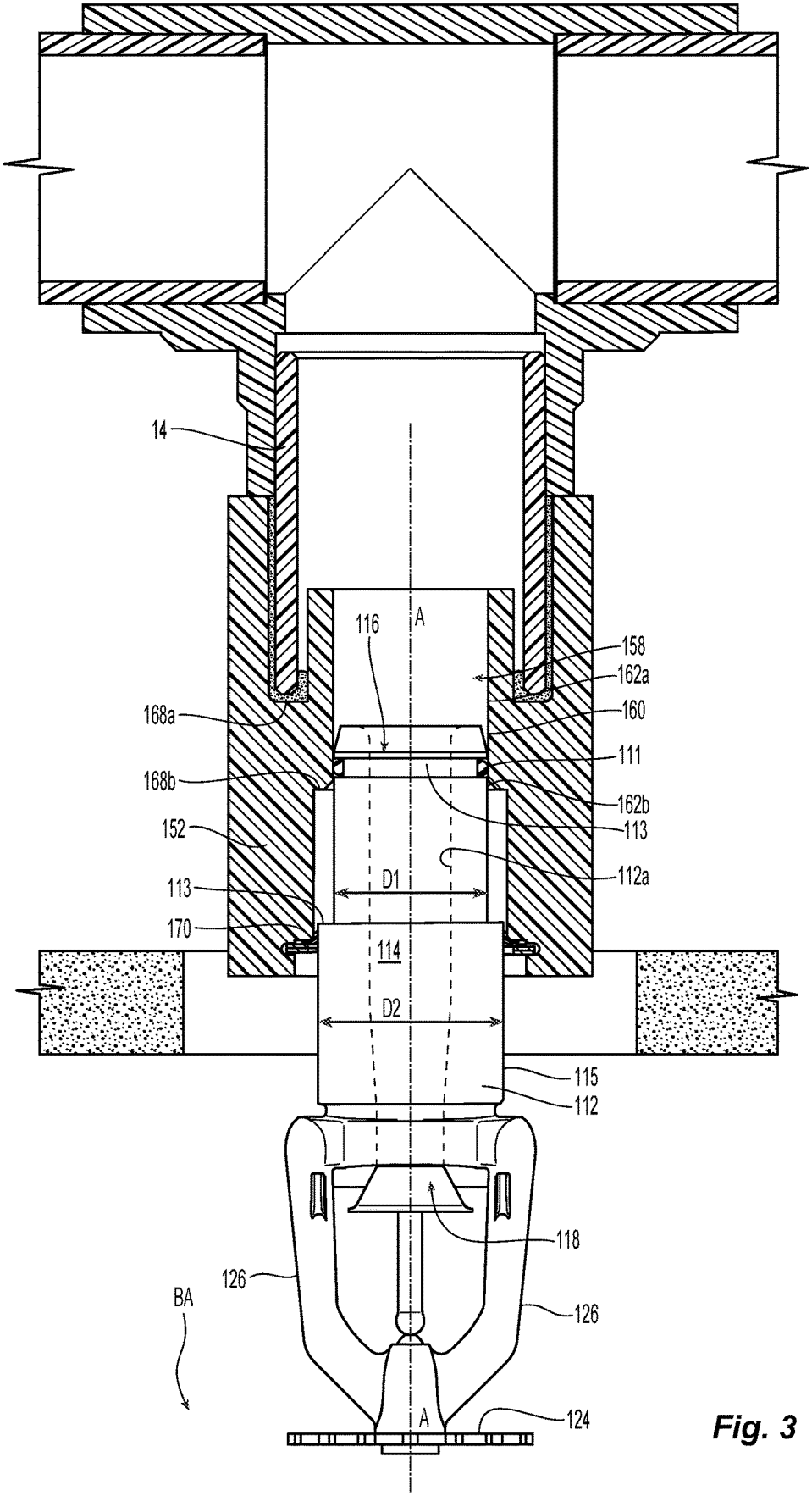
FIG. 3 is a cross-sectional schematic view of a sprinkler assembly installation.

Again with reference to FIGS. 2A and 2B, in some embodiments the sprinkler 110 is initially inserted into the tubular member 152 to first locate the inlet 116 of the sprinkler 110 within the sealing surface 160. The inlet 116 is first located within the sealing surface 160 in order to positively align the sprinkler 110 within the fitting 150 before either the sealing member 111 is brought into sealing contact with the sealing surface 160 and/or before the trailing portion 115*b* of the sprinkler 110 mechanically engages the gripper portion 170. Subsequently, the sprinkler 110 can be further advanced into the fitting 150 to engage the trailing portion 115*b* of the sprinkler 110 with the gripper ring 170, as depicted in FIG. 2C, to mechanically connect and couple the fitting 150 and the sprinkler 110. In some embodiments, the gripper portion 170 engages the trailing portion 115*b* before the sealing member 111 engages the sealing surface 160. FIG. 2D depicts the sprinkler 110 being further inserted to form an initial fluid tight sealing contact between the sealing member 111 and the sealing surface 160. As depicted in FIG. 2E, the sprinkler 110 can be fully inserted such that the shoulder 113 contacts the second stop surface 168' to stop the sprinkler advancement and locate the deepest position of the sealing member 111 within the sealing surface 160. Accordingly, the sprinkler assembly can have a range of sealing member positions. By providing a range of locations over which a fluid tight seal can be formed, there is flexibility in completing the sprinkler assembly 100 and the relative spacing between the components of tubular member 152 and the sprinkler 110. For example, the adjustability provides for adjustment of the deflector 124 with respect to the tubular member 152, the sealing surface 160 or with respect to other installation structures, such as the ceiling barrier depicted in FIG. 3.

In some embodiments, the shoulder surface 113 is located along the encasing surface 115 so that upon complete insertion of the sprinkler 110 into the fitting 150 the axial distance between the shoulder surface 113 and the gripper portion 170 is greater than the axial distance between the seal member 111 and the shoulder surface 113. In some embodiments, as depicted in FIG. 2A, the axial length L1 of the sealing surface 160 is smaller than the axial length L2 between the second stop surface 168*b* and the gripper portion 170. In some embodiments, engagement between the sprinkler 110 and the gripper portion 170 is maintained after the seal member 111 and seal surface 160 are disengaged thereby relieving the fluid seal between the sprinkler body 112 and the tubular member 150 before completely decoupling the two components.

The sprinkler 110 can be mechanically and adjustably axially held, retained or supported within the tubular member 152 by the gripper portion, which can include a gripper ring 170. The gripper ring 170 includes an annular base 174 from which fingers or prongs 172 extend radially inward and are equiangularly spaced about the ring's center. Each of fingers or prongs 172 is a resilient member which flexes with respect to the annular base 174 to vary the distance of the radially innermost end of the finger from the ring center. The gripper ring 170 can be affixed within the tubular member 152 to circumscribe the longitudinal axis.

The trailing portion 115*b* of the outer encasing surface 115 can include or define a surface for the adjustable mechanical connection with the internal gripper ring 170 of the fitting 150. The trailing portion 115*b* can include a helical thread. For example, the thread can be a square thread, a straight thread, a buttress thread and/or a swept thread. As was described above, the sprinkler 110 can be initially inserted into the tubular member 152 axially or linearly pushed or driven into the fitting 150 to enable contact between the gripper ring 170 and the threaded surface of the trailing portion 115*b*. The fingers or prongs 172 of the gripper ring 170 are splayed outwardly by the passing contact the crests of the threads upon insertion of the sprinkler body 112 into the fitting 150. With the prongs of the gripper ring 170 splayed outwardly, the sprinkler body can be linearly inserted into position.

The engagement between the gripper ring 170 and the trailing portion 115*b* of the sprinkler limits removal of the sprinkler body 112 from the fitting to linear and rotational translation in the direction from the first end 154 to the second end 156 of the tubular member 152. The ends 172*a* of the prongs 172 of the gripper ring 170 are engaged within the valley or groove of the threads of the trailing portion 115*b*. Linearly withdrawing the sprinkler 110 from the tubular member results in the thread elements forcing the prongs 172 of the gripper ring 170 radially inward to grip the sprinkler body 112. Thus, the sprinkler 110 can be prevented from being axially driven out of the fitting 150 under the axial force of the water supply or by inadvertent impact. In order to remove the sprinkler or disengage the fluid tight seal, the sprinkler 110 is linearly and rotationally translated with respect to the tubular member 152 from the first end 154 to the second end 156.

Given the axial spacing between internal components of the assembly previously described, the sprinkler 110 can be initially rotationally translated or unthreaded to first release the sealed engagement between the sealing member 111 and the sealing surface 160 before disengaging the trailing portion 115*b* of the sprinkler body 112 from the gripper ring 170. The initial unthreading can release any fluid pressure from the sprinkler assembly 100 before safely and completely removing the sprinkler 110 by continued unthreading. The removed sprinkler 110 can be serviced or replaced.

In some embodiments, the engagement between the gripper ring 170 and the sprinkler body 115 also allows for the sprinkler body 110 to be threaded and advanced into tubular member 152 in order to, for example, more finely locate the seal member 111 along the seal surface 160. Thus, the trailing portion 115*b* can have an axial length defining a range of axial adjustment of the deflector 124 with respect to the sealing surface or other components of the sprinkler 110 or structures of an installation.

Figure 4:
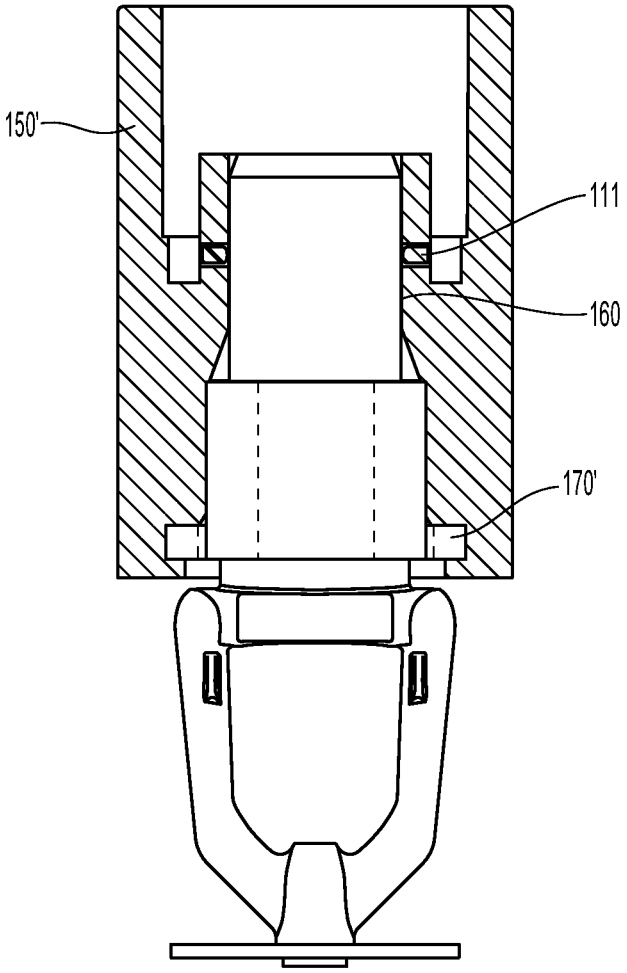
FIG. 4 is a diagram of an embodiment of the sprinkler assembly for use in the installations of FIGS. 1 and 3.

Depicted in FIG. 4 is an embodiment of the fitting 150, in which the gripper portion can include an internal thread 170 formed along the inner surface. In some embodiments, the trailing portion 115*b* includes a complimentary external thread for engaging the internal thread. The leading portion 115*a* of the sprinkler body can be first inserted within the sealing surface to positively align the sprinkler 110 for threaded engagement with the tubular member 150. In some embodiments, the sealing member 111 can also be affixed along the sealing surface 160 instead of affixed about the sprinkler body 112.

Figure 5:
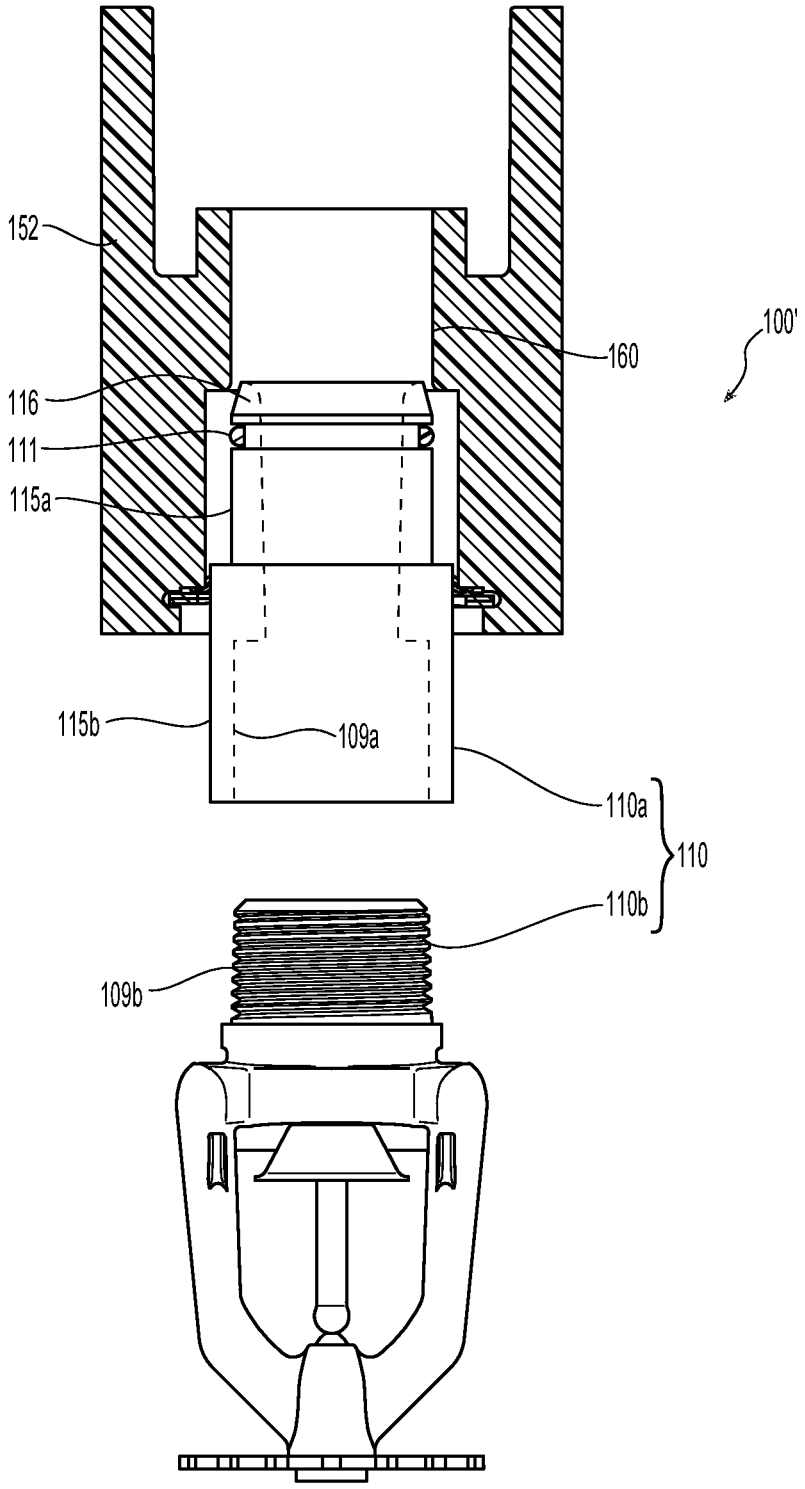
FIG. 5 is a diagram of an embodiment of the sprinkler assembly for use in the installations of FIGS. 1 and 3.

As described herein, the sprinkler assembly 100 can include a sprinkler body 110 that is integrally formed. FIG. 5 depicts embodiments of a sprinkler assembly 100' in which the sprinkler 110 includes a sprinkler insert 110*a* and a separate sprinkler component 110*b* that is coupled to the insert 110*a*. The insert 110*a* includes an encasing surface having the leading and trailing portions 115*a*, 115*b* as previously described. The insert 110*a* also includes an internal thread 109*a* for complimentary threaded engagement with the external thread 109*b* of the sprinkler component 110*b*. The external thread 109*b* can be a tapered thread, such as for example, NPT thread. In some embodiments, the sprinkler 110*b* can be an externally threaded sprinkler for engagement with insert 110*a* and assembled with the fitting 150. Accordingly, the sprinkler assembly 100' can provide for an adapter to convert a standard threaded sprinkler into a sprinkler assembly for push-to-connect-rotate-to installation.

While the present disclosure has been disclosed with reference to certain embodiments, numerous modifications, alterations, and changes to the described embodiments are possible without departing from the sphere and scope of the present disclosure, as defined in the appended claims. Accordingly, it is intended that the present disclosure not be limited to the described embodiments, but that it has the full scope defined by the language of the following claims, and equivalents thereof.

What is claimed is:

1. A sprinkler assembly comprising:

a connection fitting including a tubular member, the tubular member comprising:

a first insertion end, a second insertion end, and an internal conduit extending between the first insertion end and the second insertion end along a longitudinal axis;

an exterior surface and an inner surface, the inner surface defining a sealing surface between the first and second insertion ends circumscribed about the longitudinal axis, the inner surface including a gripping portion axially spaced from the sealing surface between the sealing surface and the second insertion end;

a first stop surface internal from the first insertion end and outward from the sealing surface relative to the longitudinal axis, the first stop surface defining a depth of insertion through the first insertion end past an opening of the internal conduit; and a second stop surface along the inner surface between the sealing surface and the gripping portion; and a fire protection sprinkler having a body defining an inlet and an outlet with a passageway extending between the inlet and the outlet along the longitudinal axis, a deflector supported by the body and spaced from the outlet, the body having an outer encasing surface surrounding the longitudinal axis, the outer encasing surface including a leading portion and a trailing portion for insertion in the second insertion end of the tubular member with the leading portion being received within the sealing surface before the trailing portion engages the gripping portion.

2. The sprinkler assembly of claim 1, wherein the leading portion and the trailing portion each define an external diameter, the external diameter of the leading portion being smaller than the external diameter of the trailing portion.

3. The sprinkler assembly of claim 1, wherein the sealing surface and the gripping portion define an internal diameter, the internal diameter of the sealing surface being smaller that the internal diameter of the gripping portion.

4. The sprinkler assembly of claim 3, wherein the inner surface defines a transition surface between and contiguous with each of the sealing surface and the gripping portion, the transition surface being skewed with respect to the longitudinal axis.

5. The sprinkler assembly of claim 4, wherein the transition surface is orthogonal with respect to the longitudinal axis.

6. The sprinkler assembly of claim 4, wherein the transition surface defines a chamfer contiguous with the sealing surface.

7. The sprinkler assembly of claim 1, wherein the gripping portion includes a gripper ring affixed along the inner surface.

8. The sprinkler assembly of claim 7, wherein the trailing portion of the outer encasing surface includes an external thread for engaging the gripper ring.

9. The sprinkler assembly of claim 7 wherein the gripper ring includes a plurality of resilient prongs skewed with respect to the longitudinal axis such that the prongs permit axial translation of the sprinkler within the internal conduit in the direction from the second insertion end to the first insertion end and prevent the axial translation within the internal conduit from the first insertion end to the second insertion end.

10. The sprinkler assembly of claim 1, wherein the gripping portion includes an internal thread formed along the inner surface.

11. The sprinkler assembly of claim 1, wherein the leading portion includes an O-ring affixed about the leading portion between the inlet and the trailing portion for sealing engagement with the sealing surface.

12. The sprinkler assembly of claim 11, wherein the trailing portion includes an external thread axially spaced from the O-ring such that O-ring forms a sealed engagement with the sealing surface before the external thread engages the gripping portion.

13. The sprinkler assembly of claim 1, wherein the sealing surface includes an O-ring affixed along the sealing surface to form a sealed engagement along a portion of the leading portion.

14. The sprinkler assembly of claim 13, wherein the trailing portion includes an external thread axially, the O-ring forming a sealed engagement with the leading portion before the external thread of the trailing portion engages the gripping portion of the connection fitting.

15. The sprinkler assembly of claim 1, wherein the sealing surface has an axial length defining a range of axial adjustment of the deflector with respect to the sealing surface.

16. The sprinkler assembly of claim 1, wherein the leading portion of the sprinkler body has an axial length greater than the gripping portion of the fitting.

* * * * *